US010632471B2

(12) United States Patent
Pallmann

(10) Patent No.: US 10,632,471 B2
(45) Date of Patent: Apr. 28, 2020

(54) DEVICE FOR COMMINUTING FEED MATERIAL

(71) Applicant: PALLMANN MASCHINENFABRIK GmbH & Co. KG, Zweibruecken (DE)

(72) Inventor: Hartmut Pallmann, Zweibruecken (DE)

(73) Assignee: PALLMANN Maschinenfabrik GmbH & Co. KG, Zweibruecken (DE)

( * ) Notice: Subject to any disclaimer, the term of this patent is extended or adjusted under 35 U.S.C. 154(b) by 481 days.

(21) Appl. No.: 15/292,725

(22) Filed: Oct. 13, 2016

(65) Prior Publication Data

US 2017/0100720 A1 Apr. 13, 2017

(30) Foreign Application Priority Data

Oct. 13, 2015 (DE) ..... 10 2015 117 430

(51) Int. Cl.
*B02C 13/06* (2006.01)
*B02C 13/28* (2006.01)
(Continued)

(52) U.S. Cl.
CPC ..... *B02C 13/06* (2013.01); *B02C 13/02* (2013.01); *B02C 13/10* (2013.01); *B02C 13/13* (2013.01);
(Continued)

(58) Field of Classification Search
CPC ..... B02C 13/06; B02C 13/08; B02C 13/10; B02C 13/12; B02C 13/13; B02C 13/18; B02C 23/16
(Continued)

(56) References Cited

U.S. PATENT DOCUMENTS 3,236,723 A * 2/1966 Whiteside ..... D21B 1/08 162/191
4,113,191 A * 9/1978 Wattles ..... B02C 13/18 241/188.2
(Continued)

FOREIGN PATENT DOCUMENTS

CA 2286960 A1 * 4/2000 ..... B02C 13/08
DE 1 905 286 A1 10/1970
(Continued)

OTHER PUBLICATIONS

Oskar, DE 2447808 translated, 1976.*
(Continued)

*Primary Examiner* — Adam J Eiseman
*Assistant Examiner* — Bobby Yeonjin Kim
(74) *Attorney, Agent, or Firm* — Muncy, Geissler, Olds & Lowe, P.C.

(57) ABSTRACT

A device for processing feed material, with a housing enclosing a processing space in which a rotor rotatable about the axis of rotation is arranged. The rotor has a rotor disk at which circumference a plurality of axially disposed impact plates is arranged uniformly distributed. A coaxially arranged processing path surrounds the impact plates while maintaining a working gap. Via a material inlet, the device is fed in the axial direction with feed material centrally ending in the processing space, which upon deflection in the region of the rotor disk is fed in the radial direction to the working gap. To ensure complete and gentle processing of the feed material while maintaining its original taste, smell and color, the processing path is part of a basket rotating about the rotational axis.

16 Claims, 5 Drawing Sheets

(51) Int. Cl.

| | |
|---|---|
| ***B02C 13/30*** | (2006.01) |
| ***B02C 13/02*** | (2006.01) |
| ***B02C 13/10*** | (2006.01) |
| ***B02C 13/13*** | (2006.01) |
| ***B02C 23/16*** | (2006.01) |

(52) U.S. Cl.
CPC ..... *B02C 13/28* (2013.01); *B02C 13/30* (2013.01); *B02C 23/16* (2013.01); *B02C 2023/165* (2013.01)

(58) Field of Classification Search
USPC ..... 241/188.1, 191, 192, 73, 74
See application file for complete search history.

(56) References Cited

U.S. PATENT DOCUMENTS

| | | | | |
|---|---|---|---|---|
| 6,435,433 | B1 | 8/2002 | Hesch | |
| 2005/0103909 | A1* | 5/2005 | Lin | B02C 13/04 241/89.3 |

FOREIGN PATENT DOCUMENTS

| | | | | | |
|---|---|---|---|---|---|
| DE | 1905286 | A1 | * | 10/1970 | B02C 13/13 |
| DE | 24 47 808 | B1 | | 3/1976 | |
| DE | 2447808 | B1 | * | 3/1976 | B02C 13/09 |
| DE | 26 20 797 | A1 | | 12/1977 | |
| DE | 272 418 | A1 | | 10/1989 | |
| DE | 42 27 202 | A1 | | 2/1993 | |
| DE | 4439449 | A1 | * | 5/1996 | B02C 13/06 |
| DE | 198 48 233 | A1 | | 10/1999 | |
| DE | 199 10 208 | A1 | | 9/2000 | |
| DE | 100 48 886 | A1 | | 4/2002 | |
| DE | 10 2010 036 650 | A1 | | 2/2012 | |
| GB | 2061762 | A | * | 5/1981 | B02C 13/08 |
| WO | WO-2012013653 | A1 | * | 2/2012 | B02C 13/08 |

OTHER PUBLICATIONS

Pallmann, DE 1905286 translated, 1970.*
Meersche, DE 4439449 translated, 1996.*
Zimmer, WO 2012013653 translated, 2012.*

* cited by examiner

DEVICE FOR COMMINUTING FEED MATERIAL

This nonprovisional application claims priority under 35 U.S.C. § 119(a) to German Patent Application No. 10 2015 117 430.8, which was filed in Germany on Oct. 13, 2015, and which is herein incorporated by reference.

BACKGROUND OF THE INVENTION

Field of the Invention

The invention relates to a device for the comminution of feed material with a housing enclosing a processing space, in which a rotor rotatable about a rotational axis is arranged, wherein the rotor has a rotor disk at which circumference a plurality of axially aligned impact plates are arranged uniformly distributed, which are surrounded by a coaxially arranged processing space while maintaining a working gap, wherein the device is fed material in an axial direction by means of a material inlet centrally opening into the processing space, and the feed material, after deflection in the area of the rotor disk, is fed in the radial direction to the working gap.

Description of the Background Art

During processing of organic substances such as foodstuffs and feed material, spices or lignocellulosic materials and the like, operators of corresponding installations are confronted with different challenges, depending on the type of feed material and the desired end product, wherein in a variety of cases, the main consideration is the pure comminution of the feed material to a predetermined size and shape.

However, the processing of foodstuffs and feed material also requires a gentle way of material processing, as the gustatory and olfactory properties as well as the original color of the final product should be maintained. This applies in particular to the processing of spices, which occur mostly in the form of nuts, grains, leaves and roots, and which generally have volatile aromatic substances, such as, for example, essential oils. Too much heat input during feed material processing results in a loss of the volatile substances, which represents a considerable loss in quality. Foodstuffs and feed material also have a tendency of adhering to machine parts due to their relatively high moisture content as well as their fat and oil-containing ingredients. There is therefore a risk of material accumulation during processing, which hinders an undisturbed flow of material through the processing machine and therefore requires regular cleaning, in turn increasing the proportion of machine downtimes.

When preparing lignocellulosic materials such as bagasse or bark, on the other hand, the challenge may be to extract substances from the feed material, for example, fiber-containing ingredients, which are needed as raw material for further production processes such as the production of panel materials, or as starting materials for extracting plant extracts.

Both the specific properties of the raw materials and of the final products determine the technical features of the machines used. To this end, the use of universal mills, pin mills, hammer mills, impact mills and the like is known for the processing of organic substances. These mills are characterized by a high comminution capacity, but simultaneously cause a relatively high heat input into the product, which particularly in the treatment of foodstuffs and spices leads to a loss in taste-determining substances. To achieve comminution at low temperatures, it is already known in this regard to add a coolant such as $CO_2$ during processing.

SUMMARY OF THE INVENTION

It is therefore an object of the invention to provide complete and gentle processing of organic substances while preserving their original taste, smell and color.

This object is achieved in an exemplary embodiment by a device in which the processing path is part of a basket rotating about the axis of rotation, wherein the processing path is divided in the axial direction into a first track section and at least one further, second track section adjoining axially thereon, and wherein the face of the rotor disk facing the feed opening ends with its outer peripheral area in the separating plane between the first path section and the second path section or in the region of the first track section.

A substantial advantage of the invention compared to known devices results from the combination of a rotor disk whose relative position within the basket according to the invention allows for the entire feed flow to be successively processed first in the area of the first processing path, and then in the area of the second processing path, with a continuously variable differential speed between the rotor and the basket, which allows for an individual adaptation of the processing to the nature and sensitivity of the feed material. The interaction of these two features ensures that the entire feedstock is completely processed, taking into account the characteristic properties of the feedstock. For example, at a low differential speed, heat-sensitive or brittle materials such as foodstuffs and spices can be crushed extremely gently, while when selecting a higher differential speed, hard feed material such as grain is subjected to more intensive processing. The result is a homogeneous end product in shape and size as well as material and taste, which also meets the highest quality requirements.

In an embodiment of the invention, the first processing path and the second processing path embody different processing modes, for example, in that the first processing path has a baffle web and the subsequent second processing path has a screen web. In the course of the successive cycle of the two processing paths, the feed material is gradually processed within the device, wherein each stage can be adapted to the respective requirements of the material processing, or wherein it is the interaction of the two stages that leads to a desired overall result.

In this sense, it is also possible to modify the inner circumference of the individual processing paths that is active during machining by integrating individual circumferential sections. Thus, circumferential sections with other shaping or with screens can be used as a first processing path in a baffle web, and/or circumferential sections without perforation or with comminuting effect can be used in a screen web as a second processing path. In this way, a finely graduated adaptation of an inventive device to the respective feed material is provided. Preferably, the successive circumferential sections are flush with one another in the circumferential direction, which promotes a uniform material flow through the device.

Furthermore, it can prove to be advantageous for certain types of processing if the surfaces of the first track section and the second track section, which are active during processing, merge in an axially aligned manner. The radial width of the working gap present in the area of the first track section is maintained in this embodiment in the region of the second track section, which promotes radial material passage in the area of the second track section.

A further optional possibility for modifying the material processing is an embodiment of the invention in which the impact plates are divided into two impact plate parts, wherein the first impact plate part is assigned to the first processing path and the second impact plate part is assigned to the second processing path. This, on the one hand, permits the use of differently designed impact plate parts in the different processing stages; on the other hand, the radial gap between the active impact plate edge and the associated track section in the different track sections can be chosen to be of a different size, in order to, for example, control the residence time of the feed material in the respective track section.

The axially parallel impact plates enclosing the basket in the shape of a collar have their ends extending into the region of the carrier disk or the ring carrier disk. In order to achieve the most efficient processing of the feed material, preferably, the axial gap between one end of an impact plate and the adjacent disk is a maximum of 50 mm, most preferably a maximum of 20 mm.

To minimize maintenance and repair-related downtime, the areas of the carrier disk and the ring carrier disk axially opposing the impact plates are designed to be wear-resistant. For this purpose, for example, a ring or a plurality of ring segments made of a wear-resistant material may be arranged, or the window surface is tempered in this area.

An embodiment of the invention is characterized by means which supply a process gas to the material flow in the processing zone. In the simplest case, the process gas is a cooling medium which counteracts excessive heating of the feedstock in the course of the material processing. However, it is also possible to supply conditioned gas to the machining process, in order to, for example, dry or moisten the feed material, or to regulate the moisture content in the final product.

In addition, it is possible to feed substances to the feedstock with the process gas, which provide the end product with advantageous properties. For example, taste or odor alteration or flavor enhancers, or substances for color change or color intensification of the final product may be added. A further possibility is to add substances to the feedstock to improve the shelf life of the final product, for example, preservatives or substances to maintain a certain consistency of the final product, for example, to prevent clumping and caking of the material particles.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
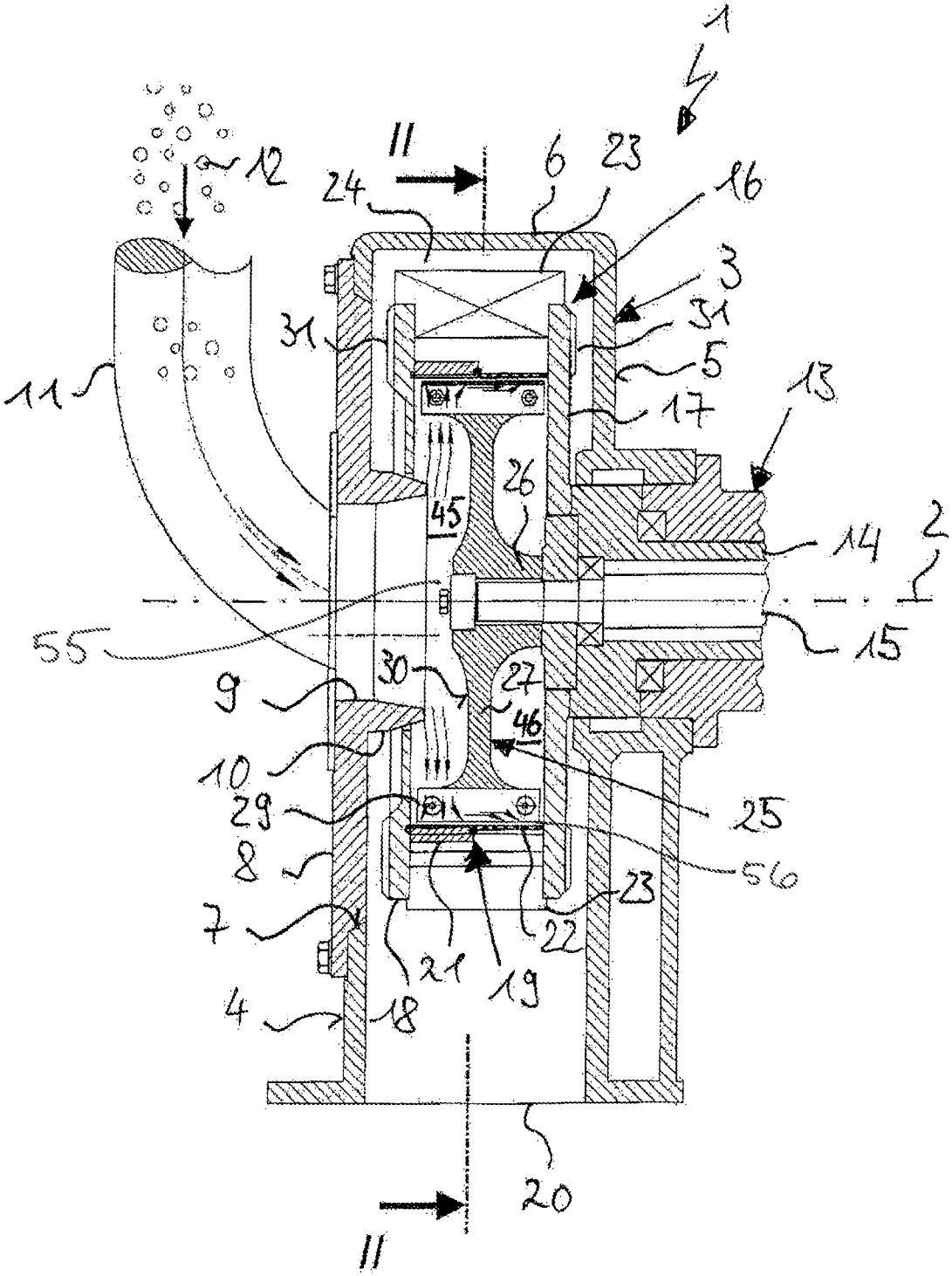
FIG. 1 is a longitudinal section through a first embodiment of a device according to the invention, along the line I-I shown in FIG. 2.
Figure 2:
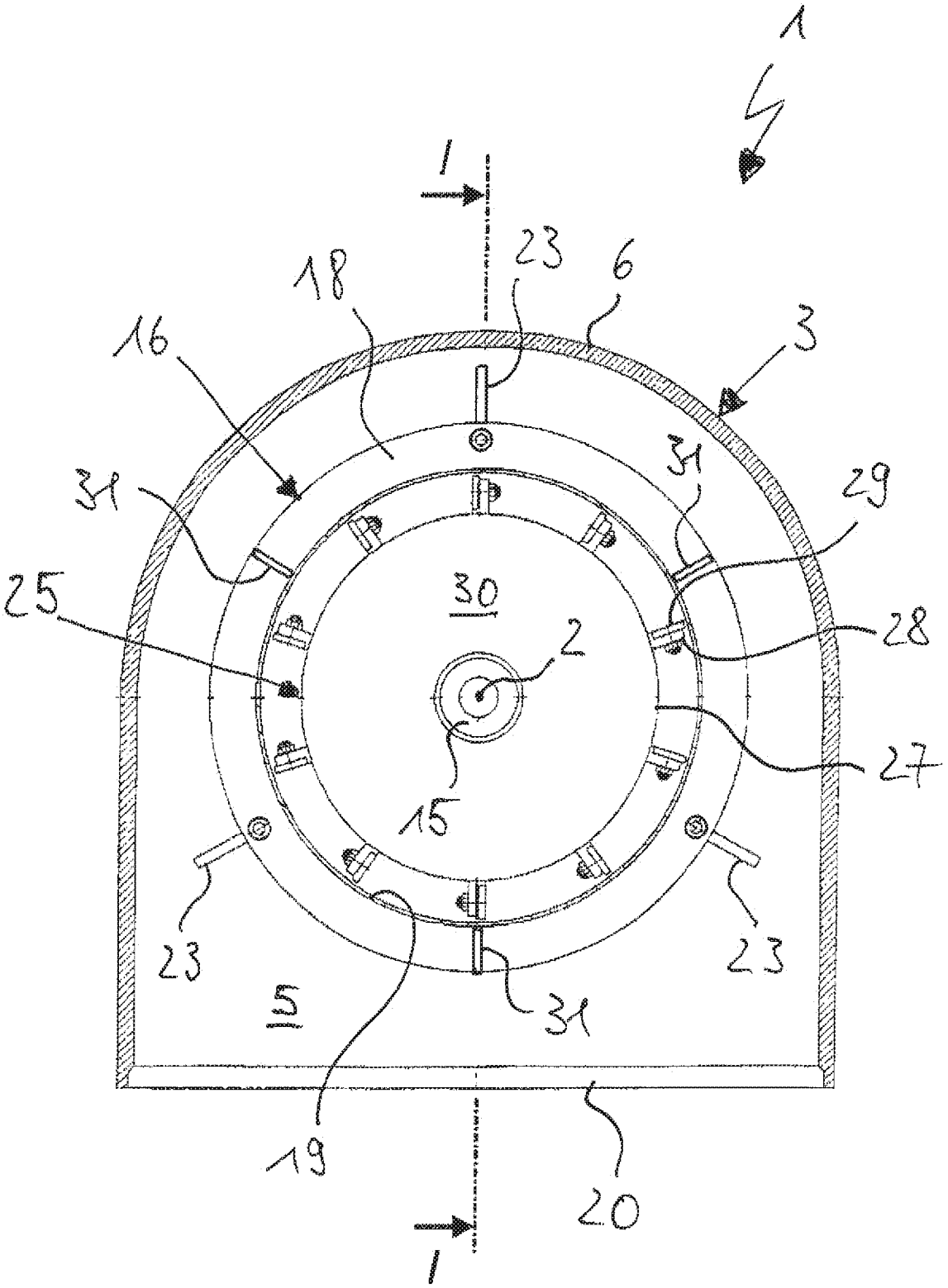
FIG. 2 is a cross-sectional view through the device shown in FIG. 1, along the line II-II shown there.

FIGS. 1 and 2 show a first embodiment of the inventive device 1 in the form of an impact mill. The device 1 has one cylindrical housing 3 enclosing a rotational axis 2, with a housing front wall 4, a housing rear wall 5 and a housing shell 6 connecting the front wall 4 and the rear wall 5.

The housing front wall 4 has an opening 7 concentric with the axis of rotation 2, which can be closed by means of a pivotable housing door 8. Concentric to the rotational axis 2, the housing door 8 has a feed opening 9, at which edge facing the housing interior, a circumferential projection 10 is arranged opening into a processing space 55. On the opposite, outer side of the housing door 8, a tubular material inlet 11 connects to the opening 7, by means of which an axial feed of the device 1 with feed material 12 takes place. To discharge the sufficiently processed material, the housing 3 opens downwards and thus forms a material outlet 20.

On the rear wall 5 of the housing 3, in the region around the axis of rotation 2, a shaft bearing 13 is attached, in which a first drive shaft 14 is rotatably mounted in the form of a hollow shaft for rotatably receiving a second drive shaft 15. Both first and second drive shafts 14, 15 each have on their ends situated outside the housing 3 a multi-groove disk (not shown), which is driven in the same or opposite direction at a differential speed.

With its end located inside the housing 3, the first drive shaft 14 bears a basket 16 which coaxially surrounds the axis of rotation 2. The basket 16 is essentially composed of a support disk 17 perpendicular to the axis which is coaxially opposed by a support ring disk 18 at an axial distance. The insides of the support disk 17 and the support ring disk 18 are connected via an equally coaxially aligned, cylindrical processing path 19. The basket 16 is seated with the support disk 17 on the first drive shaft 14, while the support ring disk 18 abuts the outer circumference of the extension 10 of the housing door 8 with its inner circumference in a sliding manner. In order to prevent a passage of material there, which would result in unprocessed feed material directly entering the material outlet 20, the connection of the support ring disk 18 is formed as a sealing gap 44 on the projection 10 of the housing door 8.

Figure 5:
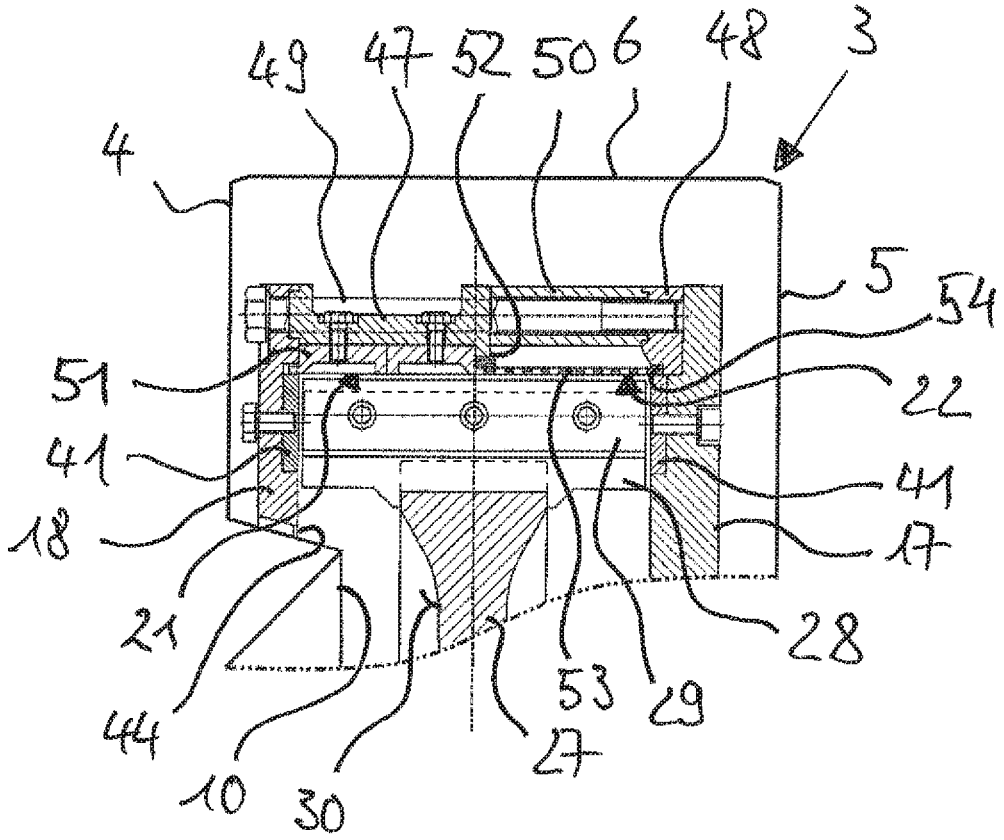
FIG. 5 is a longitudinal section through a fourth embodiment of the device according to the invention, in the region of the working gap.

In the present exemplary embodiment, starting at the support ring disk 18 in the axial direction, the processing path 19 is subdivided into a first cylindrical track section 21 and an adjoining, second cylindrical track section 22. The first track section 21 is formed by a baffle web 51 (see FIG. 5) with fluted portions in order to comminute and pulp the feed material. It is possible to modify the baffle web 51 by section, for example, with different shaping or through the integration of individual screening surfaces. The subsequent second track section 22 has a screen web (e.g., perforated screen 53 as shown in FIG. 5) which allows for radial passage of the feed material after comminution thereof under the hole diameter. With a suitable screen design or by sectional integration of impact segments or segments without perforation into the screen, a part of the comminution work can also take place in the region of the second track section 22.

Finally, in the outer peripheral region of the basket 16, there are three winged or scoop-like strippers 23, which are uniformly and mutually spaced apart between support disk 17 and support ring disk 18, radially outwards into the region of the housing shell 6 and, in the course of their rotation, keep the channel 24 formed between housing shell 6 and basket 16 free from deposits. To support the airflow through the device 1, the support disk 17 and support ring disk 18 also comprise fan blades 31 that radially extend outwardly on the outer sides facing the housing 3.

Within the basket 16, a rotor 25, which also rotates about the axis 2, is arranged. The rotor 25 comprises a hub body 26 with which is non-rotatably mounted on the end of the second drive shaft 15 situated inside the housing 3. The hub body 26 monolithically reaches radially outwards to a rotor disk 27, the thickness of which increases in the region of the outer circumference and which outer circumference has a number of uniformly spaced brackets 28 in the circumferential direction which are designed to fasten axially parallel impact plates 29. The radially outer effective edges of the impact plates 29 lie on a common circle track and form a working gap 56 with the processing path 19.

The rotor disk 27 thereby divides the space enclosed by the basket 16 into a first chamber 45, delimited by the support ring disk 18 and the rotor disk 27, and a second chamber 46, delimited by the support disk 17 and the rotor disk 27.

The relative axial position of the rotor disk 27 to the processing path 19 is such that the face 30 of the rotor disk 27 which faces the feed opening 9, is disposed in the region of the first track section 21 or in the separating plane between the first track section 21 and the second track section 22. In this way, the feed material 12 is fed completely to the first track section 21 in the region of the first chamber 45, before it reaches the region of the second track section 22.

During operation of a device 1 according to the invention, the basket 16 is driven at a differential speed over the first drive shaft 14, and the rotor 25 via the second drive shaft 15. With synchronous driving at only a small rotational speed difference, a particularly gentle processing mode can be realized. With an increase in speed differences up to an opposing movement of basket 16 and rotor 25, on the other hand, the proportion of the quantity of comminuting energy introduced into the feed material can be infinitely increased and thus, the crushing performance improved.

The feed material 12 first passes via the feed line 11 and through the feed opening 9 in the axial direction into the central region of the rotor 25, where it is deflected outward in a radial direction at the face 30 of the rotor disk 27. As a result of the relative position of the face 30 of the rotor disk 25 to the processing path 19, the material flow is first completely fed to the first track section 21, and there, crushed and pulped sufficiently, before the feed material reaches the axially adjoining region of the second processing path 22 in the form of a screen web. After radial passage of the sufficiently processed material through the second track section 22, it is fed into the material outlet 20 in the channel 24.

Figure 3:
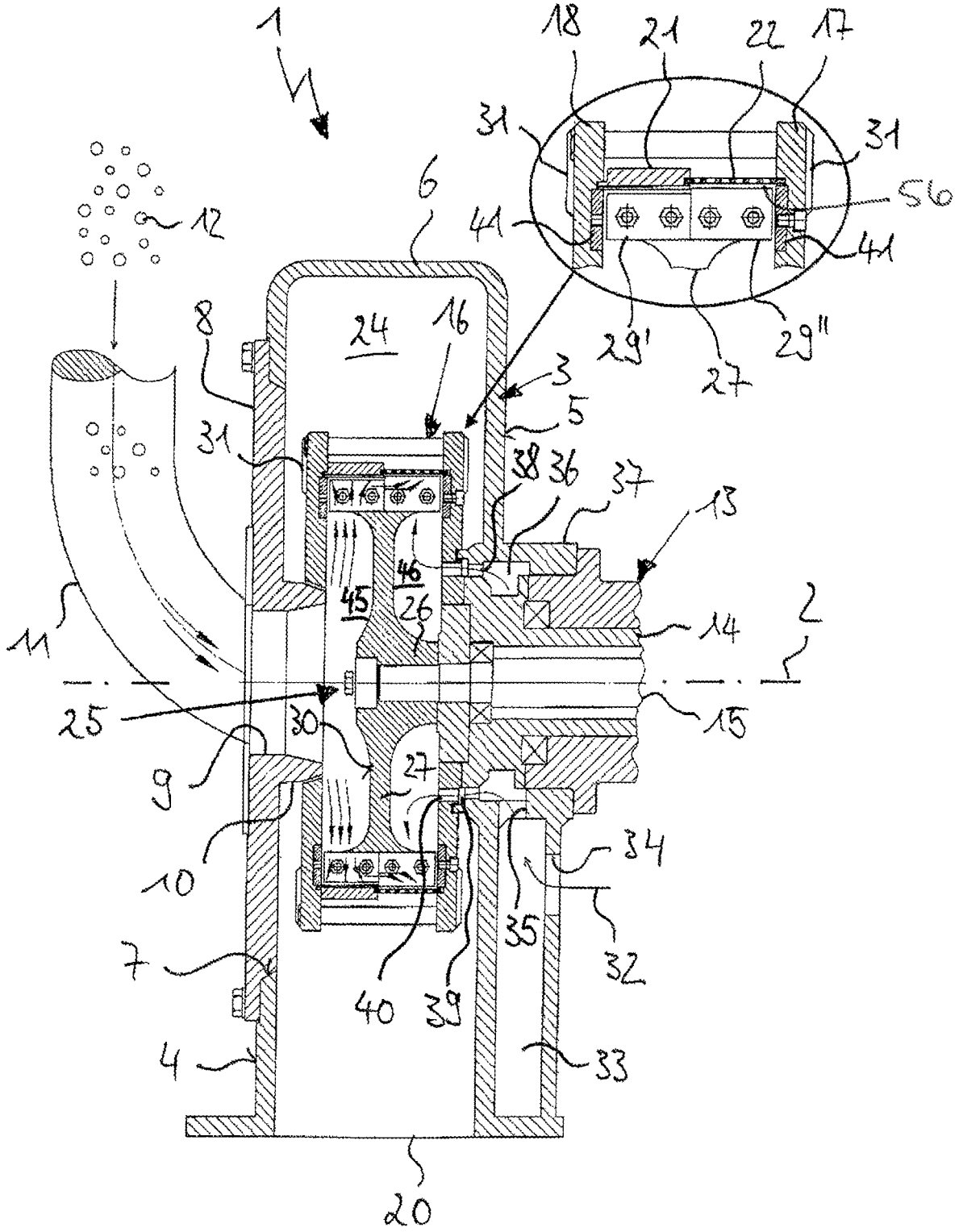
FIG. 3 is a longitudinal section through a second embodiment of the device according to the invention, in the region of the working gap.

FIG. 3 shows a further development of the device 1 shown in FIGS. 1 and 2, so that as long as the same conditions apply, the foregoing applies accordingly and identical reference numbers are used. The various modifications realized on the device 1 can be the subject of further embodiments of the invention, individually and independently of one another, or as can be seen in FIG. 3, can exist cumulatively in a single embodiment.

A first modification relates to the supply of a process gas to the region of the processing zone. The process gas can have a pure cooling function and/or a drying function, to which end ambient air or conditioned gas is fed into the housing 3. However, it is also possible to add substances to the material flow, which alter its properties. These substances can be, for example, flavorings which influence the flavor of the final product, and/or substances which contribute to the shelf life of the end product, and/or substances which give the product a certain color or preserve its color.

As can be seen from FIG. 3, the process gas 32 is fed from the rear side of the device 1. For this purpose, a cavity 33 is formed at the rear side of the housing 5 in the region below the shaft bearing 13, said cavity being charged with process gas 32 via an opening 34. Via a further opening 35, the process gas 32 discharges from the cavity 33 into an annular space 36 coaxially enclosing the first drive shaft 14. The outer boundary of the annular space 36 is formed by a projection 37 at the housing rear 5 centrically circulating the axis 2. Via axial through-bores 38, the process gas 32 enters the interior of the housing 3, where it is distributed in a further annular space 39, before finally passing through bores 40 in the support disk 17 into the second chamber 46 between the rotor disk 27 and the support disk 17, where it is guided radially into the region of the second track section 22, where it is mixed with the material flow.

Another modification relates to the formation of the impact plates 29, which in the embodiment shown in FIG. 3 are divided in the axial direction, into a first impact plate part 29' which interacts with the first track section 21, and a second impact plate part 29" which interacts with the second track section 22. The first impact plate part 29' and/or the second impact plate part 29" are fixed in the respective holders 28 in a radially adjustable manner, so that the radial width of the working gap 56 in the region of the first track section 21 and/or the second track section 22 is individually adjustable, whereby, for example, the length of stay of the feed material in the track sections 21, 22 can be adjusted individually.

Furthermore, FIG. 3 shows a further modification in which the regions axially opposing the ends of the impact plates 29, 29', 29" located on the inner sides of support disk 17 and support ring disk 18 have wear protection. In the present exemplary embodiment, the wear protection includes, in each case, a ring 41 or of ring segments which are joined to form a ring 41, which are bolted to the support disk 17 or the support ring disk 18.

Figure 4:
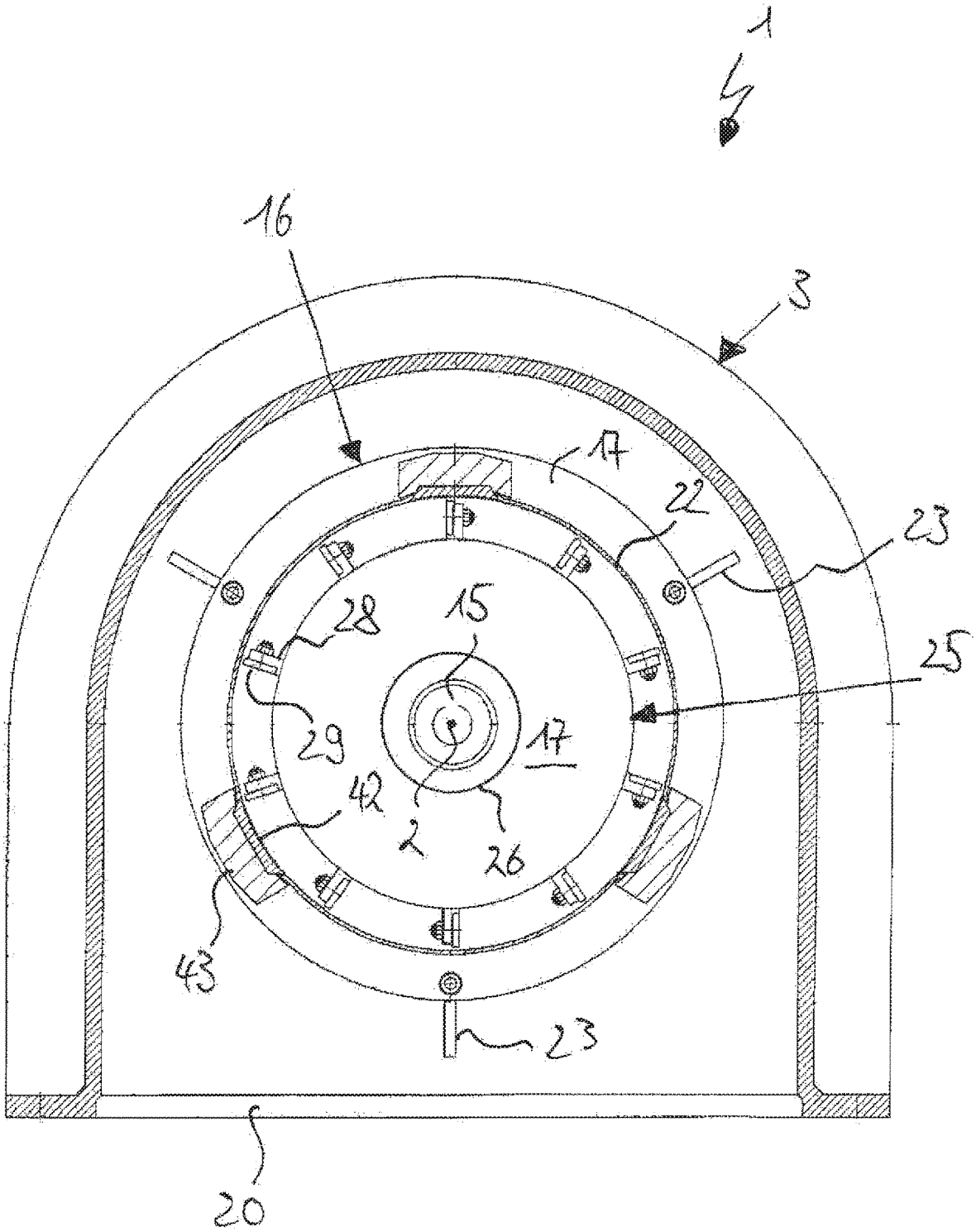
FIG. 4 is a cross-section through a third embodiment of a device according to the invention, in the region of the second track section with a view to the housing rear wall.

The embodiment of the invention illustrated in FIG. 4 is in turn based on the embodiment shown in FIGS. 1 and 2 or FIG. 3, so that, in order to avoid reiterations, reference is made to the latter embodiments. In contrast to the embodiments described above, the second track section 22 has gaps in the circumferential direction, where circumferential sections 42 are interspersed in the second track section 22. The second track section 22 and the interspersed circumferential sections 42 are flush with each other in the circumferential direction. The circumferential sections 42 can be, for example, without perforation and, if appropriate, have a profiled surface at their inner circumference. If the circumferential sections 22 are made of baffle web sections, as shown in FIG. 4, then these are supported in the radial direction by beams 43 axially extending between the support disk 17 and the support ring disk 18.

Analogously to this embodiment, the first track section 21 can also have gaps in the profiling in the circumferential direction, where the first track section 21 is replaced by different circumferential sections. These circumferential sections can differ from another, for example, by a different profile or by means of a sieve-like configuration.

The subject of FIG. 5 is a further embodiment of the invention, which is substantially the same as the ones described above, but is characterized by an arrangement of the first track section 21 and the second track section 22, in which the inner circumference of the first track section 21 is at the same radial distance from the axis of rotation 2 as the inner circumference of the second track section 22.

For this purpose, the processing path 19 comprises a base ring 47 assigned to the first track section 21 and a bearing ring 48 assigned to the second track section 22. The base ring 47 is centered coaxially with the axis 2 via a form-fit at the inner side of the support ring disk 18. The same applies to the bearing ring 48, which engages positively on the inner side of the support ring 17 and is also coaxially aligned with the axis 2. By means of a plurality of clamping bolts 49 which are distributed over the circumference and which in each case permeate the support ring disk 18 and engage in the support ring 17 with their threaded portion, the base ring 47 and bearing ring 48 are fixed in their position, whereby in each case a spacer sleeve 50 slipped onto the clamping bolt 49 provides the appropriate axial distance between base ring 47 and bearing ring 48.

In the transition region to the second track section 22, the base ring 47 has a circumferential ring shoulder 52 extending over the inner shell surface in the direction of the axis 2, which serves as a first bearing surface for the edge of a second track section 22. The opposing edge of the perforated screen 53 is supported by a second bearing surface, which is formed by a circumferential recess 54 in the bearing ring 48. By means of optional adjustment devices such as distance plates, lining pieces or adjusting screws which are arranged between the bearing surfaces and the perforated sieve 53, the relative position of the second track section 22 can be adjusted. FIG. 5 clearly shows that the clear radial distance of the first track section 21 to the axis 2 corresponds to the clear radial distance of the second track section 22 to the axis 2. The inner shell surface of the first track section 21 and the second track section 22 are thus aligned in the axial direction.

The remaining components, such as housing 3, rotor 25, impact plates 29, rings 41, etc., correspond to the above-described embodiments, so that what was said there applies accordingly. Thus, it is also apparent from FIG. 5 that the face 30 of the rotor disk 27 is disposed in the region of the first track section 21 at least with its outer peripheral region.

The invention is not limited to the feature combinations disclosed in the individual embodiments. Rather, combinations of features of different embodiments self-explanatory to those skilled in the art are also possible within the scope of the invention.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A device for processing feed material, the device comprising:

a housing enclosing a processing space;

a rotor arranged in the processing space and arranged such to be rotatable about a rotational axis, the rotor having a rotor disk at which circumference a plurality of axially aligned impact plates is arranged distributed uniformly, which are surrounded by a coaxially arranged processing path while maintaining a working gap; and a material inlet in which the device receives feed material in the axial direction, the material inlet opens centrally into the processing space, and after radial deflection in a region of the rotor disk, the feed material is fed in a direction of the working gap, wherein the processing path is part of a basket which rotates about the rotational axis, which is divided in an axial direction into a first track section and a second track section adjoining axially thereon, wherein a face of the rotor disk facing the material inlet ends with its outer peripheral region in a separating plane between the first track section and the second track section or in an area of the first track section, wherein the basket includes a support disk and a support ring disk arranged coaxially with one another, which carry the processing path over their circumference, wherein the support disk is provided with bores through which a process gas is supplied to the material flow in a chamber between the rotor disk and the support disk, and wherein the material inlet is provided on a first side of the housing and on a second side of the housing, that opposes the first side, the housing has an enclosed cavity that is separate from the processing space, wherein the process gas is introduced into the cavity from an opening in an exterior wall of the housing, wherein the housing has an interior opening that forms a fluid outlet for the process gas inside the cavity, the fluid outlet being in fluid communication with the bores provided in the support disk of the basket, such that the process gas from the cavity is supplied to the chamber between the rotor disk and the support disk.

2. The device according to claim 1, wherein the first track section is formed wholly or partly from a baffle web in the circumferential direction.

3. The device according to claim 1, wherein the second track section is wholly or partly formed by a screen web.

4. The device according to claim 1, wherein the second track section is formed by a screen web which is interspersed by circumferential sections of a baffle in the circumferential direction.

5. The device according to claim 4, wherein an inner circumference of the screen web and an inner circumference of the circumferential sections are disposed on a common peripheral circle, relative to the rotational axis.

6. The device according to claim 1, wherein the first track section is at the same clear radial distance from the rotational axis as the second track section.

7. The device according to claim 1, wherein the impact plates extend axially between the support disk and the support ring disk.

8. The device according to claim 1, wherein ends of the impact plates maintain an axial distance from the support disk and the support ring disk, wherein the axial distance is at a maximum of 50 mm.

9. The device according to claim 1, wherein the support disk and the support ring disk are at least partly equipped with wear protection on their mutually facing sides.

10. The device according to claim 1, wherein the impact plates are divided in the axial direction, with a first impact plate part in a region of the first track section and a second impact plate part in a region of the second track section.

11. The device according to claim 10, wherein the first impact plate part and/or the second impact plate part are mounted radially adjustable on the rotor for purposes of adjusting the working gap.

12. The device according to claim 1, wherein the device comprises a first drive shaft for driving the basket and a second drive shaft for driving the rotor, and wherein the first drive shaft is formed by a hollow shaft in which the second drive shaft of the rotor is rotatably mounted.

13. The device according to claim 1, wherein the basket has radially outwardly extending strippers.

14. The device according to claim 1, wherein ends of the impact plates maintain an axial distance from the support disk and the support ring disk, wherein the axial distance is at a maximum of 20 mm.

15. The device according to claim 1, wherein the basket has outwardly extending strippers, wherein one end of each of the strippers is directly attached to the support disk and another end of each of the strippers is directly attached to the support ring disk.

16. The device according to claim 9, wherein the wear protection includes a ring or ring of segments provided on an inner surface of the support disk and a ring or ring of segments provided on an inner surface of the support ring disk.

* * * * *